US010294077B2

(12) United States Patent
MacDonald et al.

(10) Patent No.: US 10,294,077 B2
(45) Date of Patent: May 21, 2019

(54) FOLDING ATTIC STAIRWAY TRANSPORT SYSTEM

(71) Applicants: Tena MacDonald, Indianapolis, IN (US); John MacDonald, Auburn, IN (US)

(72) Inventors: Tena MacDonald, Indianapolis, IN (US); John MacDonald, Auburn, IN (US)

( * ) Notice: Subject to any disclaimer, the term of this patent is extended or adjusted under 35 U.S.C. 154(b) by 752 days.

(21) Appl. No.: 14/956,603

(22) Filed: Dec. 2, 2015

(65) Prior Publication Data

US 2016/0159613 A1 Jun. 9, 2016

Related U.S. Application Data

(60) Provisional application No. 62/123,958, filed on Dec. 5, 2014.

(51) Int. Cl.
*B66B 9/08* (2006.01)
*E06B 5/01* (2006.01)
*E04F 11/06* (2006.01)

(52) U.S. Cl.
CPC ..... *B66B 9/083* (2013.01); *E04F 11/064* (2013.01); *E06B 5/01* (2013.01); *E04F 11/062* (2013.01)

(58) Field of Classification Search
CPC . B66B 9/083; B66B 9/193; B66B 9/16; E04F 11/064; E04F 11/062; E06B 5/01; E06C 7/12; E06C 7/16
See application file for complete search history.

(56) References Cited

U.S. PATENT DOCUMENTS 976,240 A * 11/1910 Winkler ..... E06C 1/20 182/103
2,394,148 A * 2/1946 Campbell ..... E06C 7/12 182/103
2,499,791 A * 3/1950 Spencer ..... A47B 51/00 312/247
2,588,959 A * 3/1952 Campbell ..... B66B 9/187 182/103
3,115,211 A * 12/1963 Ostrander, Jr. ..... E06C 7/12 182/103
3,428,145 A * 2/1969 Lyon ..... E06C 7/16 182/103
3,666,054 A * 5/1972 Ellings ..... B66B 9/16 182/103
3,859,925 A * 1/1975 Hartz ..... B61B 5/00 104/130.07
3,891,062 A * 6/1975 Geneste ..... B66B 9/16 182/103
4,183,423 A * 1/1980 Lewis ..... B66B 9/16 182/103
4,262,773 A * 4/1981 Basham ..... E04G 1/20 182/132
4,550,807 A * 11/1985 Ohlgren ..... B66B 9/16 182/141
4,793,437 A * 12/1988 Hanthorn ..... B66B 9/16 182/102

(Continued)

*Primary Examiner* — Michael E Gallion
(74) *Attorney, Agent, or Firm* — Ritchison Law Offices, PC; John D Ritchison

(57) ABSTRACT

A device and system for transporting items up and down a folding attic stairway in a building, such as a residential structure, and into an attic space finally resting securely on the floor of the attic.

17 Claims, 5 Drawing Sheets

(56) References Cited

Figures 1, 1A, 1B, 1C:
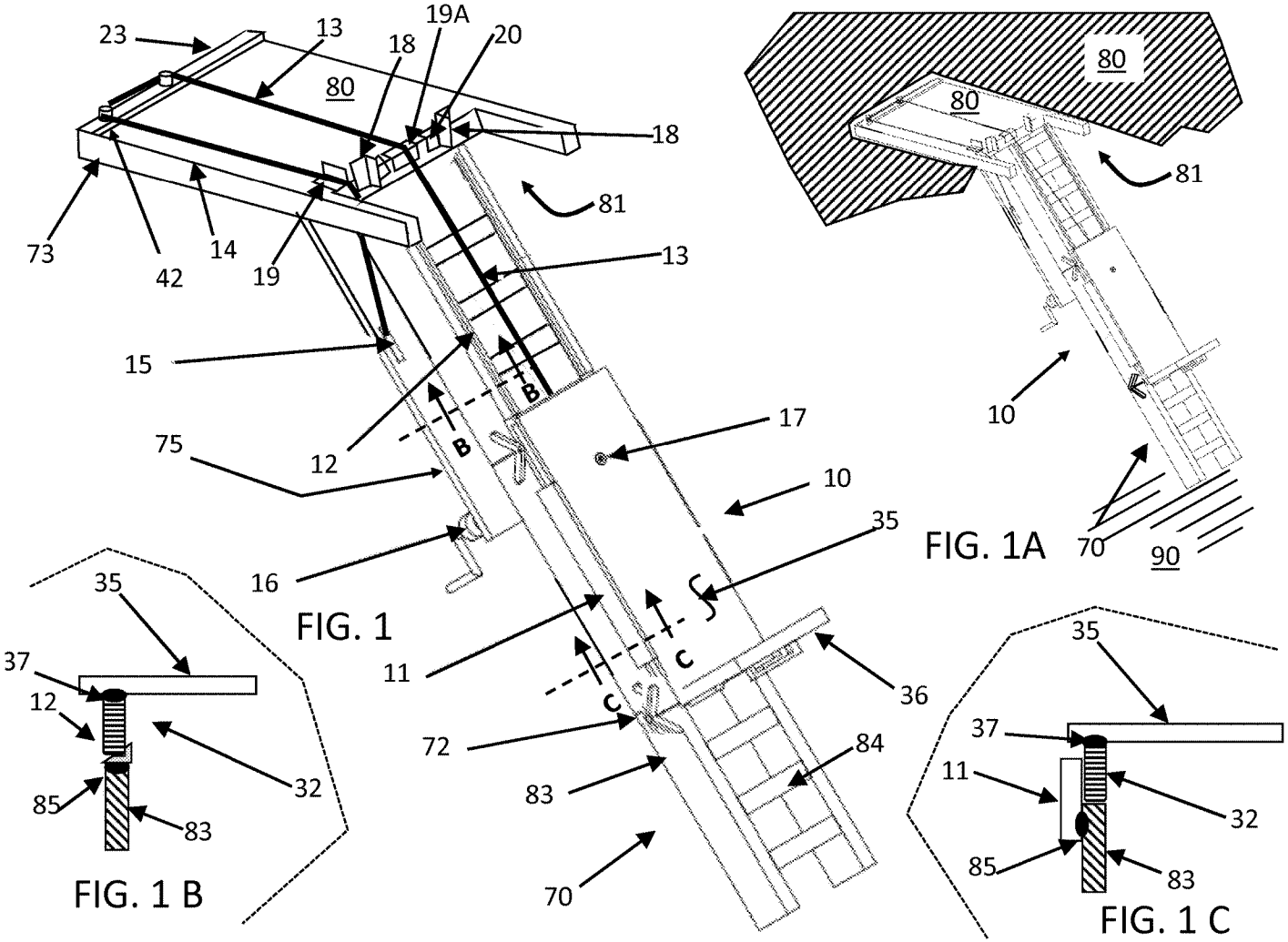

U.S. PATENT DOCUMENTS 4,875,547 A * 10/1989 Hanthorn ..... B66B 9/16 182/102
5,050,706 A 9/1991 Cole et al.
5,311,970 A * 5/1994 Basta ..... B66B 9/00 114/44
5,626,208 A * 5/1997 Sprague ..... B66B 9/025 187/267
5,911,287 A * 6/1999 Campbell ..... E06C 7/48 182/103
6,244,381 B1 * 6/2001 Ruble ..... B66B 9/187 182/103
6,533,070 B1 * 3/2003 Elrod ..... E06C 1/345 182/103
6,739,430 B2 * 5/2004 Hill ..... B66B 9/06 187/200
7,424,932 B1 * 9/2008 Murphy ..... E06C 1/345 182/103
8,002,512 B1 * 8/2011 Blehm ..... B66B 9/193 182/103
8,579,081 B2 * 11/2013 Richey ..... E06C 1/383 182/77
8,689,937 B2 * 4/2014 Grado ..... E06C 7/12 182/101
8,851,238 B2 * 10/2014 Byers ..... B66D 1/54 182/150
9,217,285 B2 * 12/2015 Connors ..... B66B 9/193
9,856,697 B2 * 1/2018 Reyes ..... E06C 7/16
2007/0107990 A1 * 5/2007 Schwertner ..... B66B 9/193 187/263
2007/0269303 A1 * 11/2007 Quare ..... E06C 7/12 414/785
2008/0060874 A1 * 3/2008 Lair ..... E06C 1/12 182/77
2008/0093176 A1 * 4/2008 Rosenthal ..... B66B 9/083 187/241
2015/0273250 A1 * 10/2015 Bina ..... A62B 99/00 182/8
2018/0086601 A1 * 3/2018 Okonski ..... B66B 9/08
2018/0100351 A1 * 4/2018 Bright ..... E06C 1/10

* cited by examiner 80
81
10
70
90

35
32
83
37
11
85

36
84
17
B
C
18
13
20
19A
19
14
42
23
73
15
75
12
16
72

32
83
12

10
36
73
22
31
32
42

23
17, 91
21
35
10
80
81
42
37
13
73
36

21
13
37
73
23
17, 91
35
10
36
22
81
31

21
32
37
35

FOLDING ATTIC STAIRWAY TRANSPORT SYSTEM

CROSS-REFERENCE TO RELATED APPLICATIONS

This application claims the benefit of United States Provisional Patent Application with Ser. No. 62/123,958 filed Dec. 5, 2014 by Tena MacDonald and John MacDonald and entitled "Folding Attic Stairway Transport System".

FIELD OF INVENTION

This present invention relates generally to a device for transporting materials up a folding overhead stairway or ladder. More particularly, the device relates to a transport device with a powered or manual winch to enable the movement of the materials in a safe and efficient manner.

BACKGROUND—FIELD OF INVENTION AND PRIOR ART

Background

The Folding Attic Stairway Transport System relates generally to material transport and lifting system which can be used in conjunction with a folding attic stairway or ladder to elevate materials from the garage or lower floor to the above attic floor. Extreme difficulty is often encountered in lifting heavy objects to the attic floor. Often there is material in ones hands to cause unbalance. Unsteady feet on the steps are exacerbated by the extra weight of the material transported. There may even be a need to use a second person to handle the excess weight or steady the material container being transported to and from the attic. Often back, arms and leg muscles end up strained. Or, the material is dropped and damaged. Or even worse, a person falls and is hurt in the process of moving material to and from the attic.

Problem

There is a need for an apparatus that can easily be attached to a folding stairway and used to lift loads to the surface of the attic floor. The apparatus should be capable of operating and functioning with a single person controlling the material to and from the attic floor. Accordingly, there is a need for the Folding Attic Stairway Transport System with powered or manual means such as a winch to safely and efficiently move materials up and down the stairway. The material transport can be used in conjunction with a folding stairway to lift material from a first position to a higher position. There is a further need for an apparatus that can be easily installed to fit the width of a particular stairway—existing or new. The apparatus should be capable of being folded into a compact form along with the typical folding stairway systems.

Prior Art

As far as known there are no other devices or process that perform the function of the Folding Attic Stairway Transport System. A U.S. Pat. No. 8,002,512 issued to Blehm (2011) and entitled "Material Transport" shows a material transport system and method of use. The system includes a base assembly having an adjustable width, a material support platform attached to the base assembly, the platform supported angularly above the base by support tubes attached to the base assembly, guides aligned along the length of the base assembly, the rails removably attached to the underside of the base assembly, and a left pair and a right pair of wheels axially mounted between each rail guide pair. It is portable and designed for extension ladders and the like. It does not teach or anticipate MacDonald's Folding Attic Stairway Transport System. Another U.S. Pat. No. 8,851,238 was issued to Byers in 2014 and entitled "Lifting System". "Optical coherence tomography systems and methods" Byers demonstrated an apparatus for raising and lowering objects. In accordance with some embodiments, a winch motor is adapted to rotate a winch member in opposing first and second directions to wrap/unwrap a portion of a cable on/from the winch member to raise and lower a lifting platform assembly, respectively. A tension detection switch assembly includes an on/off switch connected to the winch motor and a biasing member which exerts a bias force upon the winch member to nominally deflect the winch member to a first position which sets the switch to deactivate the winch motor in an absence of tension in the cable from the lifting platform assembly. This shows a vertical cable lifted platform unlike MacDonald's installation to the folding stairway.

Still another U.S. Pat. No. 8,579,081 issued to Richey et al in 2013 and entitled "Remote controlled overhead ladder system" demonstrated generally features of a remotely operated motor to lower and raise a set of folding stairs. It was silent as to any material transport or platform devices and was unlike MacDonald's Folding Attic Stairway Transport System. A typical folding stairway is shown in U.S. Pat. No. 5,050,706 issued to Cole et al in 1991 entitled "Ceiling Ladder". It shows and teaches a folding ladder but has no mention of the material transport system invented by MacDonald.

A U.S. Pat. No. 6,533,070 by Elrod was issued in 2003 and was entitled "Roof Buddy". It shows a raisable and lowerable platforms for use with ladders that are laid against exterior and interior walls, and against other inclined surfaces such as pitched roof surfaces. Two or more ladders can each include the platforms which are controlled by motors to raise and lower in unison. The platforms can be attached by rollers about exterior sides of the ladders or on the interior sides of the ladders, as needed. Single, two, or more ladder applications can include platforms being expandable to have enlarged surfaces. A longitudinal member such as a board, deck, etc., can also be positioned on the platform(s) so it can be used as a raisable and lowerable scaffolding system.

SUMMARY OF THE INVENTION

The Folding Attic Stairway Transport System, called the LADCAD™, is a developed transport system, which uses existing folding attic stairway of various widths and allows one person to safely store and retrieve items in/from their attic. The LADCAD™ transport system maintains the attic stairway folding capability and can be added at initial new installation or years later as a retrofit. The embodiment is a transport system that includes a base assembly transport device with runners that will rest on the attic stairway. The base assembly transport device is suspended by a cable that circles around pulleys attached to the attic floor and exits through the attic stairway cover and is attached to a winch. Alternatively, the winch can be located in the attic. The motion of moving the device up and down the stairway is operated by a manual or automated winch. Guides are attached to two sections of the attic stairway rails to control alignment as the device leaves the ceiling opening and returns to the stairway and down the stairway. One skilled in the art of stairway and attic devices notes that the guides are strategically placed on the stairway rails in order for the stairway to continue to fold into the ceiling, as expected.

OBJECTS AND ADVANTAGES

Advantages and Benefits for the Folding Attic Stairway Transport System include:

| Item | Advantages |
|---|---|
| 1 | Provides ability to store and retrieve multiple items, awkward items, bulky items and heavy items from an attic |
| 2 | Adapts to use conventional folding stairway devices |
| 3 | Maintains existing stairway capability without interference |
| 4 | Can be installed with new or existing folding attic stairways |
| 5 | Can be used by a single person to store or retrieve objects without a second person |
| 6 | Keeps the same visual garage or room image and ceiling appearance |
| 7 | Is ergonomically correct and reduces stress and strain of back and leg muscles |
| 8 | Is a safer way to transport by keeping the user's hands-free of the material |
| 9 | Provides an unload surface at the top of the stairway |
| 10 | Provides optional powered or manual (crank) winch to move material |
| 11 | Maintains the ability for ladder to fold and stairs to close |
| 12 | Provides ease in retrieving/storing items in attic |
| 13 | Eliminates the risk of dropping items |
| 14 | Eliminates the risk of personal injury from losing balance while carrying objects up/down stairway |
| 15 | Eliminates the need for person to be in attic and reaching down to lift object from person coming up stairs |
| 16 | Provides a capability to move items safely and efficiently up and down stairway to/from attic |
| 17 | Allows stairway to be device-free (due to resting destination in attic) for person to climb stairway and load/unload items |
| 18 | Allows the transport system installation not to infringe on a person choosing to use the attic stairway without the transport system |
| 19 | Is a safe adaptation to existing folding attic stairs |
| 20 | Uses Simple tools for assembly |
| 21 | Can be made with readily available processes and materials |
| 22 | Can be manufactured at relatively low costs |
| 23 | Maximizes the use of the materials with minimal scrap |

DESCRIPTION OF THE DRAWINGS—FIGURES

The accompanying drawings, which are incorporated in and constitute a part of this specification, illustrate an embodiment of the device that is preferred. The drawings together with the summary description given above and a detailed description given below serve to explain the principles of the Folding Attic Stairway Transport System. It is understood, however, that the Folding Attic Stairway Transport System is not limited to only the precise arrangements and instrumentalities shown.

FIG. 1 shows a perspective views of a transport system constructed and operated in accordance with the present invention, where the transport device is in a lowered position.

FIG. 1 A shows the system incorporated with the attic floor and the stairway resting on the lower floor such as a garage floor.

FIGS. 1 B and 1 C show section views of runners and guides.

FIGS. 2 A through 2 D show various perspective views of the transport device in its final horizontal position in its upper location in the attic.

Figure 3A:
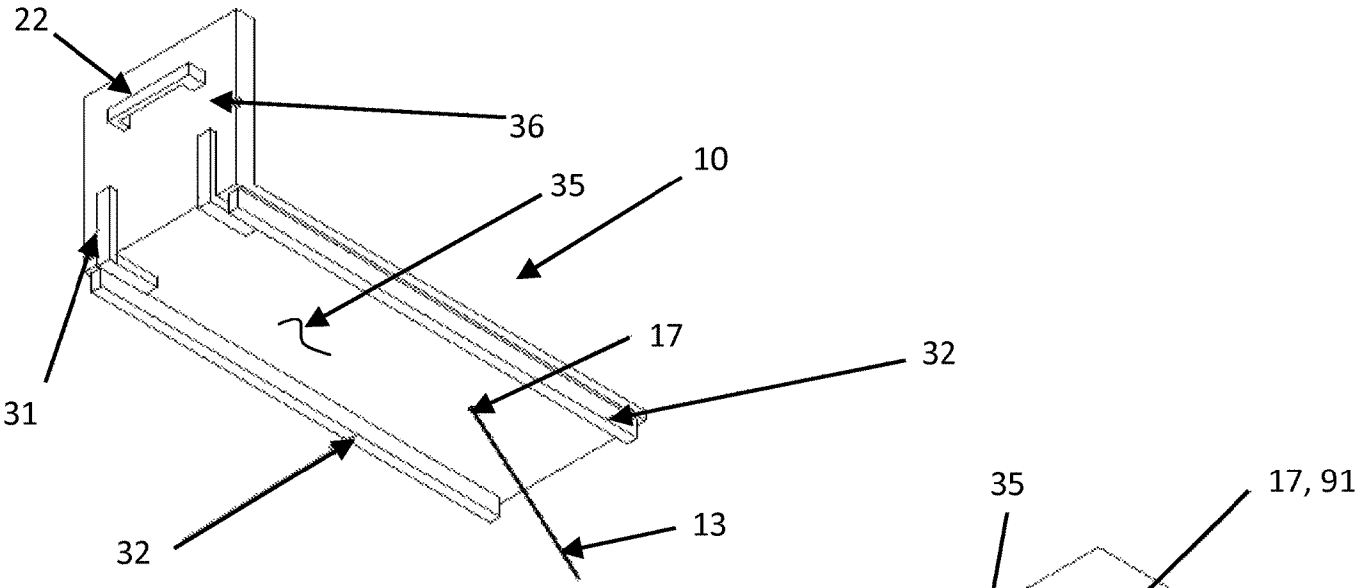
Figure 3B:
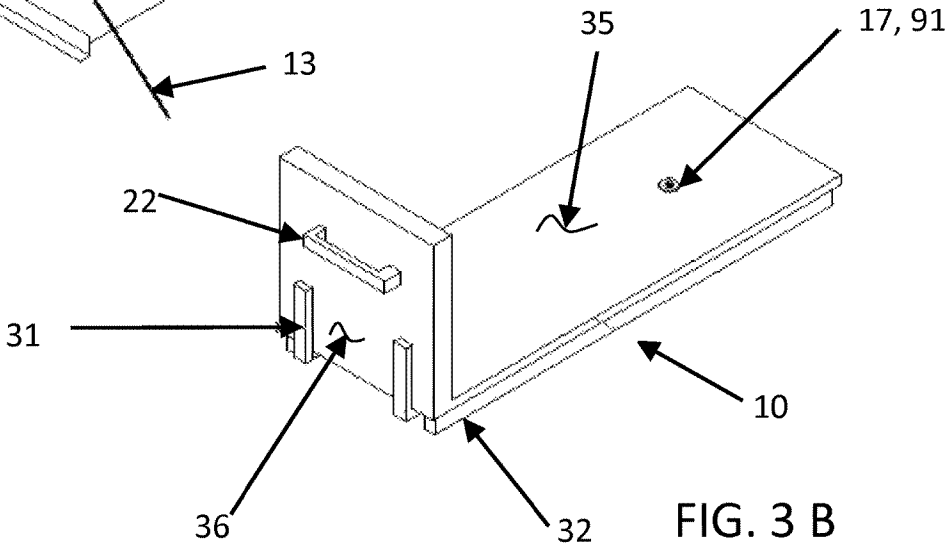

FIGS. 3 A and 3 B show various perspective views of the transport device including runners and attachment point for the cable.

Figures 4, 4A:
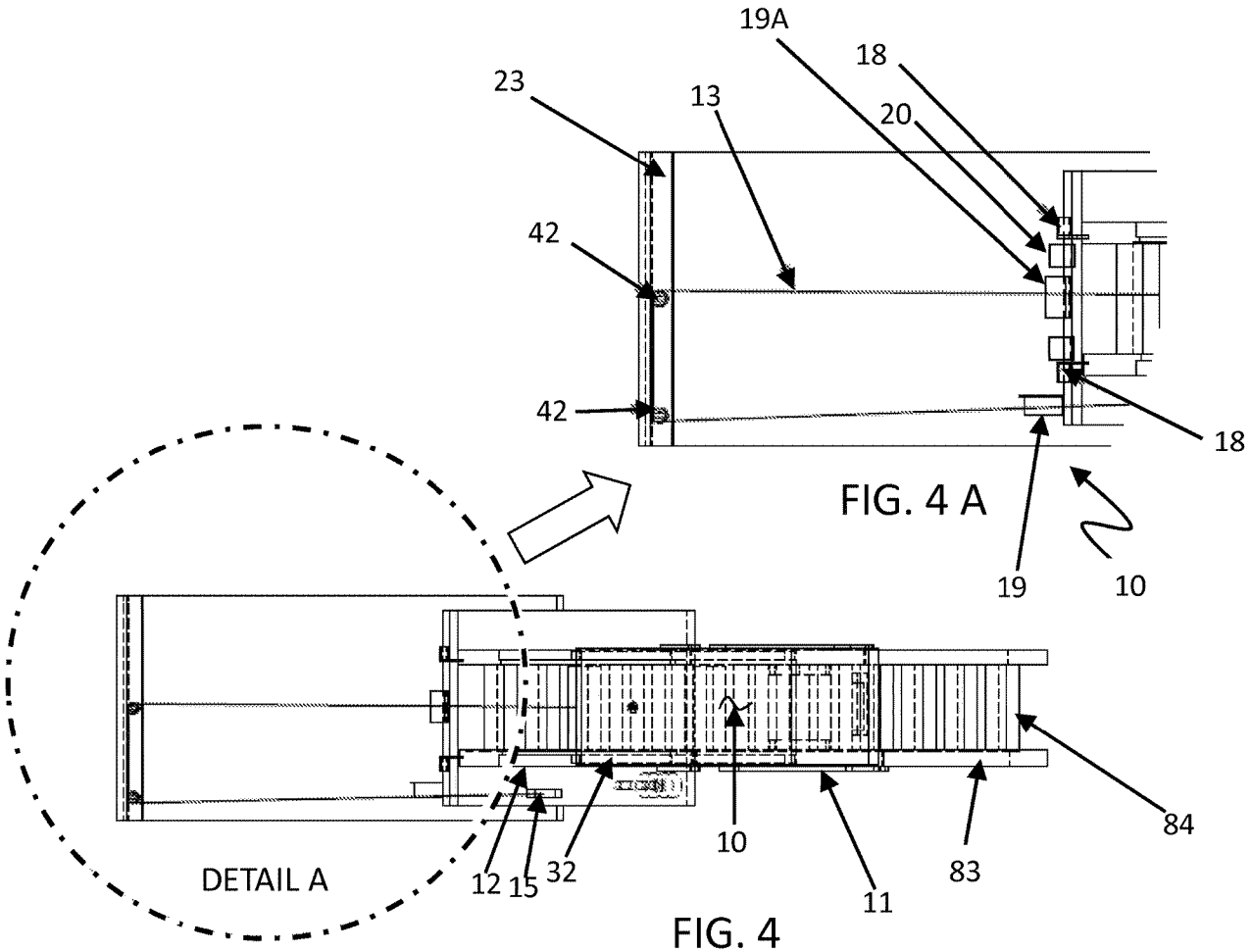

FIGS. 4 and 4 A show a top perspective view of the attic pulleys on the mounting board and details thereof.

Figure 5:
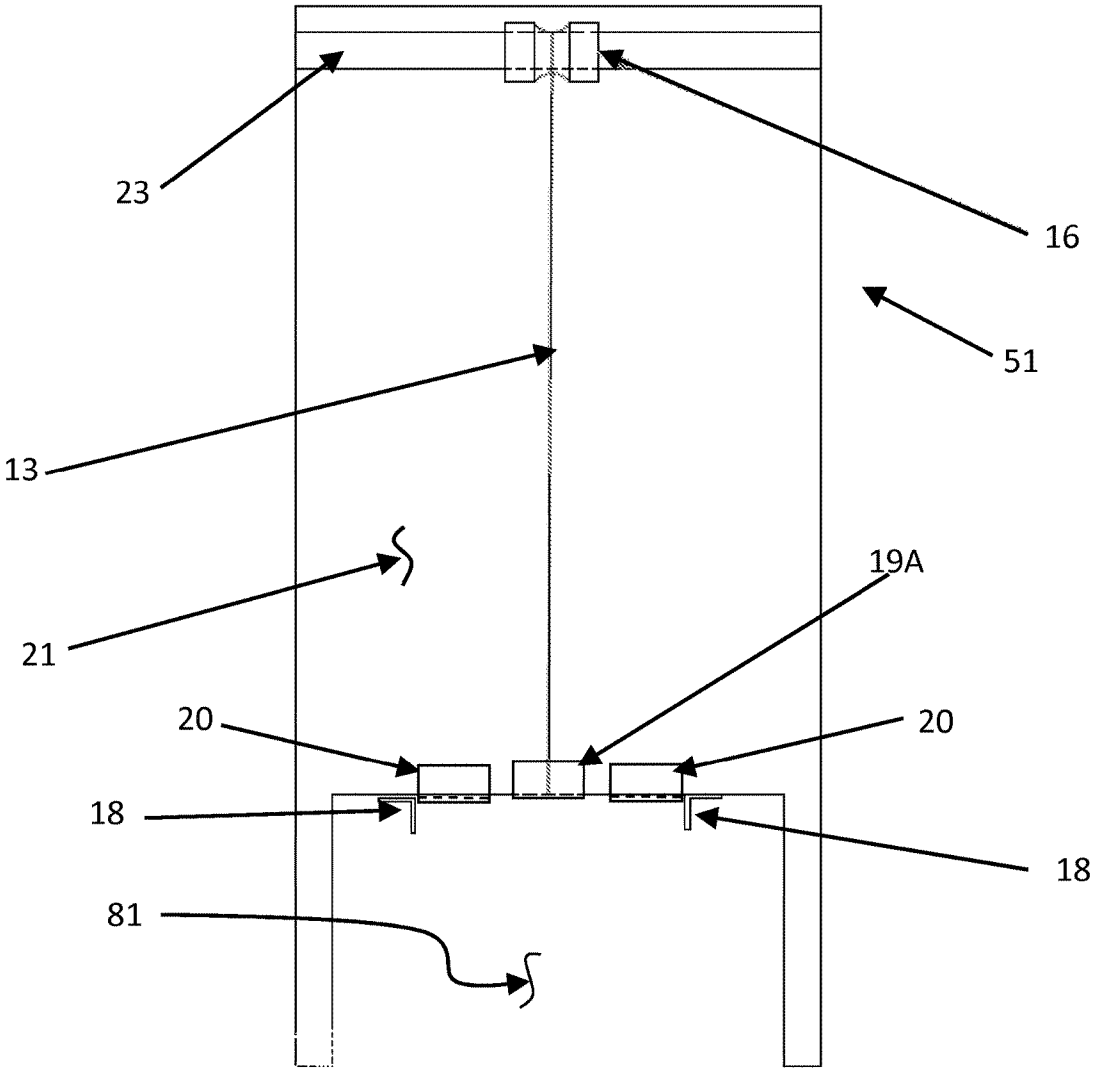

FIG. 5 shows the top view of an alternative placement for the winch in the attic rather than attached to the attic cover next to the stairway rail.

DESCRIPTION OF THE DRAWINGS—REFERENCE NUMERALS

The following list refers to the drawings:

| No. | Description |
|---|---|
| 10 | transport assembly/device 10 for a folding attic stairway 70 |
| 11 | lower section guide rails 11 rectangular structure attached contiguously to side of stairway stile 83 |
| 12 | upper section guide rails 12 angular structure attached contiguously to upper surface of stairway stile 83 |
| 13 | cable 13 |
| 14 | pulley system 14 comprised of pulleys 42 and cable 13 |
| 15 | a slot 15 cut out of the attic cover 75 for the cable 13 to pass through to the winch 16 |
| 16 | winch device 16 (powered or other) |
| 17 | cable 13 connection point 17 on platform 35 to transport device 10 |
| 18 | transport device guides 18 |
| 19 | cable guide 19 |
| 19A | cable wear strip or angle 19A |
| 20 | runner 32 wear pads/strip or angle 20 |
| 21 | upper location in the attic 21 |
| 22 | handle 22 for transport assembly |
| 23 | winch 16 and/or pulley 42 mounting board 23 |
| 31 | angle straps 31 as a means to secure end plate 36 to platform |
| 32 | lower runners 32 under transport platform 35, inset from edge of platform 35 |
| 35 | transport platform 35 |
| 36 | transport end plate 36 |
| 37 | means for securing 37 lower runners 32 to platform 35 |
| 42 | attic pulleys 42 |
| 51 | alternative placement 51 for the winch/hoist 16 in the attic |
| 70 | folding attic stairway 70 |
| 72 | hinge points 72 on side rails 83 |
| 73 | structure/joists 73 of attic floor 80 around the perimeter of the stairway 70 |
| 75 | ceiling cover structure 75 of folding attic stairway 70 |
| 80 | attic floor 80 |
| 81 | opening 81 of attic floor 80 |
| 83 | stairway stile/side rails 83 |
| 84 | stairway treads/steps 84 |
| 85 | means 85 for attaching rail guides 11, 12 to stile 83 |
| 90 | garage or lower surface floor 90 |
| 91 | means 91 for connecting cable 13 to platform 35 such as eyelets and bolts; a single shank ball and washer; and clamps and thimbles. |

DETAILED DESCRIPTION OF PREFERRED EMBODIMENT

This present invention relates generally to a device for transporting materials up a folding overhead stairway or ladder. More particularly, the device relates to a transport device with a powered or manual winch to enable the movement of the materials in a safe and efficient manner.

There are shown in FIGS. 1-5 a description of the Folding Attic Stairway Transport System. The advantages and benefits include, but are not limited to:

A. Provides ability to store and retrieve multiple items, awkward items, bulky items and heavy items from an attic
B. Adapts to use conventional folding stairway devices.
C. Maintains existing stairway capability without interference.
D. Can be installed with new or existing folding attic stairways.
E. Can be used by a single person to store or retrieve objects without a second person.
F. Keeps the same visual garage or room image and ceiling appearance.
G. Is ergonomically correct and reduces stress and strain of back and leg muscles.
H. Is a safer way to transport by keeping the user's hands-free of the material.
I. Provides an unload surface at the top of the stairway.
J. Provides optional powered or manual (crank) winch to move material.
K. Maintains the ability for ladder to fold and stairs to close.
L. Provides ease in retrieving/storing items in attic.
M. Eliminates the risk of dropping items.
N. Eliminates the risk of personal injury from losing balance while carrying objects up/down stairway.
O. Eliminates the need for person to be in attic and reaching down to lift object from person coming up stairs.
P. Provides a capability to move items safely and efficiently up and down stairway to/from attic.
Q. Allows stairway to be device-free (due to resting destination in attic) for person to climb stairway and load/unload items.
R. Allows the transport system installation not to infringe on a person choosing to use the attic stairway without the transport system.
S. Is a safe adaptation to existing folding attic stairs
T. Uses Simple tools for assembly
U. Can be made with readily available processes and materials
V. Can be manufactured at relatively low costs
W. Maximizes the use of the materials with minimal scrap The accompanying drawings, which are incorporated in and constitute a part of this specification, illustrate a preferred embodiment and examples of uses. The preferred embodiment is a Transport System for a folding attic stairway comprised of (a) a base assembly made of durable materials with a platform, an end, and a pair of runners; (b) a guiding system for the platform comprised of a lower section pair of guide rails, an upper section pair of guide rails, runner wear pads/strip or angle, and a means for connecting each of the upper and lower section pair of guide rails to a stile of the stairway whereby the bottom surface of the runners of the platform slide contiguously along the upper and lower section pair of guide rails; (c) a cable system comprised of a cable with two ends, a means to connect one end of the cable to the to the platform, a means for connecting the opposite end of the cable to a winch device, a cable wear strip/angle cable wear strip/angle, and runner wear pads/strip or angle; and (d) the winch device wherein the transport device moves up and down the extended folding stairway; and wherein the folding stairway maintains its capability and use when the transport device is resting on the attic floor. An alternative embodiment is the system wherein the winch is located in the attic and the motion of moving the platform assembly is by means of a powered winch. Another alternative embodiment is the system wherein the cable system is further comprised of a pulley system with a number of pulleys configured such that the cable encircles around pulleys and guides the cable to the location of the winch.

The details mentioned here are exemplary and not limiting. Other specific components and manners specific to describing the Folding Attic Stairway Transport System can be added as a person having ordinary skill in the field of folding stairways for attics and the like.

FIG. 1 shows a perspective view of a transport system 10 constructed and operated in accordance with the present invention, where the transport device is in a lowered position. FIG. 1 A shows the system incorporated with the attic floor and the stairway resting on the lower floor such as a garage floor. FIGS. 1 B and 1 C show section views of runners and guides which help make-up a guiding system. In FIG. 1, there it shows a perspective view of the transport system, the transport device 10 for attic stairways 70, a set/pair of lower section guide rails 11 attached to stairway rail 83 between hinges 72, an upper section guide rails 12 attached to stairway rail between upper hinge and top of stairway, and a cable 13 connected at point 17 of platform 35 to transport device 10. A winch device 16 is attached to the stairway cover 75 and a slot 15 cut out of the attic cover 75 for the cable 13 to pass through to the winch 16. The cable 13 is used to raise and lower the transport device 10 by means of the winch 16. As winch 16 is turned cable 13 that is attached to the device pulls the transport device 10 up into the attic entry opening 81, between the transport device guides 18, and over runner 32 wear pads/strip or angle 20. The pulley system shown is a cable 13 that passes over the cable wear strip or angle 19A, around pulleys 42 in attic, passes through opening in attic cover 15, is guided by the cable guide 19 and ultimately attaches to the winch 16. The device (winch) 16 that is used to raise and lower transport device is shown as a manual crank. It should be understood that other types of raising and lowering the transport device can be employed such as pulleys, electric motors (connected to line power or batteries), hydraulic motors, or the like. The powered winch/hoist or manual winch can be placed on the attic cover, on a garage wall, or in the attic. See FIG. 5 for an alternative winch location. Winch 16 and/or pulley 42 are fixed securely to a mounting board 23. One notes the powered winch can be activated by a means selected from the group consisting of simple switch, a key, a key fob, a tethered switch; and a remote control device like a garage door opener. FIG. 1 A shows the transport device 10 for a folding attic stairway 70, the attic floor 80; the opening 15 of attic floor 80; and the garage or lower surface floor 90. FIGS. 1 B and 1 C show a guiding system. FIG. 1 B shows the section view of the stairway and upper section guide rails 12 angular structure attached contiguously to upper surface of stairway stile 83. One notes the guide rails 12 angular structure, a means 85 for attaching guide rails 12 to stile 83, the platform 35, lower runner 32 (with rounded edges and ends and inset from edge of platform 35) and means for connecting 37 the platform 35 and runner 32. One also notes in FIG. 1 C is shown the pair of guide rails 11 rectangular structure, a means 85 for attaching rail guides 11 to stile 83, the platform 35, lower runner 32 (inset from edge of platform 35) and means for connecting 37 the platform 35 and runner 32. For the most part the runners 32 rest on the top surface of the pair of lower guide rails 11 and upper guide rails 12.

FIGS. 2 A through 2 D show various perspective views of the transport device 10 in its final horizontal position in its upper location in the attic 21. Shown here are the transport device 10 for a folding attic stairway 70; cable 13; a means 91 for connecting/securing at point 17 of platform 35 the cable 13 to the platform 35 of the transport device 10; upper location in the attic 21; structure/joists 73 of attic floor 80 around the perimeter of the stairway 70; angle straps 31 as a means to secure end plate 36 to platform; transport platform 35; transport end plate 36; means for securing 37 lower runners 32 to platform 35; a mounting board 23 winch 16 and/or pulley 42; and attic pulleys 42. FIG. 2 D shows the platform 35, lower runner 32 (inset from edge of platform 35) and means for connecting 37 the platform 35 and runner 32.

FIGS. 3 A and 3 B show various perspective views of the transport device 10 including runners 32 and attachment points 17 for the cable 13. Demonstrated in these views are transport device 10 for a folding attic stairway 70; cable 13; angle straps 31 as a means to secure end plate 36 to platform 35; lower runners 32 under transport platform 35; point connection point 17; means 91 for connecting cable 13 to platform 35 such as eyelets and bolts, a single shank ball and washer, and clamps and thimbles; transport platform 35; and transport end plate 36.

FIGS. 4 and 4 A show a top view of the attic pulleys 42 on the mounting board 23 and details thereof. These drawings show transport device 10 for a folding attic stairway 70; cable 13; attic entry transport 10 device guides 18; a mounting board 23 winch 16 and/or pulley 42; runner 32 wear pads/strip or angle 20; and attic pulleys 42.

FIG. 5 shows the top perspective view of an alternative placement for the winch 16 in the attic rather than attached to the attic cover next to the stairway rail. Provided in these sketches are an opening 81 of attic floor 80; a cable 13; a means 91 for connecting/securing cable 13 at connection point 17 of platform 35 to secure cable 13 to transport device 10 (not shown); a transport device guides 18; a mounting board 23 for the winch 16; runner 32 wear pads/strip or angle 20; and an alternative placement 51 for the winch/hoist 16 in the attic.

The details mentioned anticipate various material options and alternative embodiments. The transport device 10 for a folding attic stairway 70 can be made of a durable material such as wood, wood substitute, pressed wood, metals like aluminum, steel, steel alloys, etc., durable plastics, and composite materials or the like. The cable 13 can be made of various stranded metals, high tensile strength metals or composite materials or high strength plastics, strong rope, or the like. The winch 16 anticipates a manual crank, a mechanically assisted ratchet, an electrical motor, a hydraulic powered system, a pneumatic powered system, or other means for providing power to move the cable 13. The means for attaching and securing 37, 85 anticipate a secure fastening means—removable or permanent—matched to the materials used. Adhesives, threaded bolts/nuts, threaded screws, nails, pins and heavy tacks for wood; welding, brazing or forming for metals, and adhesives or molding process for composites and plastics. The cable 13 connection point 17 anticipates a means 91 for securing and connecting the ends of the cable 13 such as eyelets and bolts; a single shank ball and washer; and clamps and thimbles or the like.

The details mentioned here are exemplary and not limiting. Other specific processes, methods, and manners specific to this Folding Attic Stairway Transport System can be added to by a person skilled in the art of folding stairways for attics and other access and material transport methods and apparatuses.

OPERATION OF THE PREFERRED EMBODIMENT

The new application is for the Folding Attic Stairway Transport System called the LADCAD™. The preferred embodiment is a Transport System for a folding attic stairway comprised of (a) a base assembly made of durable materials with a platform, an end, and a pair of runners; (b) a guiding system for the platform comprised of a lower section pair of guide rails, an upper section pair of guide rails, runner wear pads/strip or angle, and a means for connecting each of the upper and lower section pair of guide rails to a stile of the stairway whereby the bottom surface of the runners of the platform slide contiguously along the upper and lower section pair of guide rails; (c) a cable system comprised of a cable with two ends, a means to connect one end of the cable to the to the platform, a means for connecting the opposite end of the cable to a winch device, a cable wear strip/angle cable wear strip/angle, and runner wear pads/strip or angle; and (d) the winch device wherein the transport device moves up and down the extended folding stairway; and wherein the folding stairway maintains its capability and use when the transport device is resting on the attic floor. An alternative embodiment is the system wherein the winch is located in the attic and the motion of moving the platform assembly is by means of a powered winch. Another alternative embodiment is the system wherein the cable system is further comprised of a pulley system with a number of pulleys configured such that the cable encircles around pulleys and guides the cable to the location of the winch.

Figures 2A, 2B, 2C, 2D:
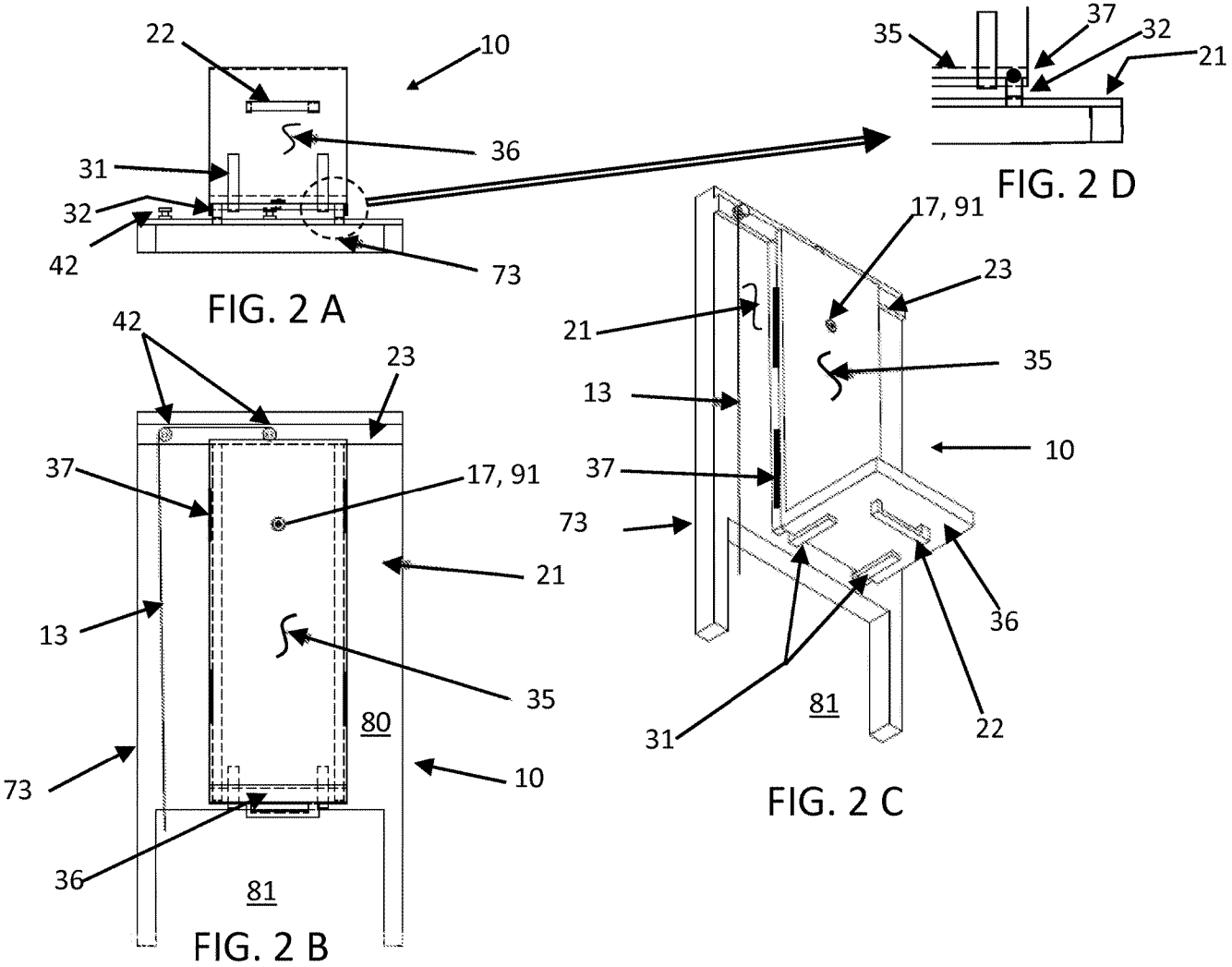

In operation, a person places load on transport device 10 while it is in its lower position as shown in FIG. 1. The load is secured in some manner by straps, ropes, bands, and the like in the usual manner. Next, the cable 13 is tensioned by the turning of the winch 16. The load and transport device travel upward along the stairway and lower 11 and upper 12 guides and attic entry guides 18 to its final upper position shows in FIG. 2C. The person can now ascend attic stairway and remove load from transport device. To bring a load from attic down stairway, a person places load on transport device 10 while it is in its upper location on the attic floor as shown in FIGS. 2 A through 2 C. The load is secured in some manner by straps, ropes, bands, and the like in the usual manner. The person then positions the device in preparation for the transport system to lower it out of the attic. The person descends the attic stairway. Next, as shown in FIG. 1, the cable 13 is tensioned by the turning of the winch 16. The load and transport device 10 travel downward along the stairway and upper guides 12 and lower guides 11 to its lower position as shown in FIG. 1. The person can now remove load from transport device 10. If automated winch/hoist is attached in attic rather than on attic cover the same above steps can be accomplish with one person. If winch in attic is a manual crank two people will be needed to accomplish operation. One person needs to be at bottom of stairway and one person in the attic.

With this description it should be understood that the Folding Attic Stairway Transport System is not to be limited to only the disclosed embodiment of product. The system called the LADCAD™ is intended to cover various modifications and equivalent arrangements included within the spirit and scope of the description.

Unless defined otherwise, all technical and scientific terms used herein have the same meaning as commonly understood by one of ordinary skills in the art to which these inventions belong. Although any methods and materials similar or equivalent to those described herein can also be used in the practice or testing of the present inventions, the preferred methods and materials are now described. All patents and publications mentioned herein, including those cited in the background of the application, are hereby incorporated by reference to disclose and describe the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A Transport System for a folding attic stairway that operates between a lower floor and an attic floor and that is comprised of:

(a) a base assembly made of durable materials with a platform, an end, runners, and a guiding system;

(b) a cable system between the platform and a winch; wherein the cable system is further comprised of a pulley system with a plurality of pulleys configured such that a cable encircles around the pulleys and guides the cable to the location of the winch; wherein at least one of the plurality of pulleys resting on the attic floor; and (c) the winch wherein the base assembly of the transport system is suspended by the cable of the cable system and the cable is lengthened and shortened by an operation of the winch and wherein the platform of the base assembly moves up and down an extended configuration of the folding attic stairway which permits the platform while carrying a load and during the operation of the winch, to reach and to rest on the attic floor and then to return back downward on the extended configuration of the folding attic stairway to reach the lower floor.

2. The Transport System for a folding attic stairway according to claim 1 wherein the motion of moving the platform assembly is by means of a powered winch.

3. The powered winch according to claim 2 is operated by an electric motor.

4. The Transport System for a folding attic stairway in claim 1 wherein the durable materials of the platform of the base assembly is selected from the group consisting of wood, wood substitute, pressed wood, metals, aluminum, steel, steel alloys, durable plastics, and composite materials.

5. The Transport System for a folding attic stairway according to claim 1 wherein the means for connecting the cable is selected from the group consisting of eyelets and bolts; a single shank ball and washer; and clamps and thimbles.

6. The Transport System for a folding attic stairway according to claim 1 wherein the cable is selected from the group consisting of high tensile strength stranded metals, composite materials, high strength plastics, or strong rope.

7. The Transport System for a folding attic stairway according to claim 1 wherein the winch is selected from the group consisting of a manual crank, a mechanically assisted ratchet, an electrical motor, a hydraulic powered system; and a pneumatic powered system.

8. The Transport System for a folding attic stairway according to claim 7 wherein the powered winch is activated by a means selected from the group consisting of simple switch, a key, a key fob, a tethered switch; and remote control device.

9. A Transport System for a folding attic stairway that operates between a lower floor and an attic floor and that is comprised of:

(a) a base assembly made of durable materials with a platform, an end, and a pair of runners;

(b) a guiding system for the platform comprised of a lower section pair of guide rails, an upper section pair of guide rails, and a means for connecting each of the upper and lower section pair of guide rails to a stile of the stairway whereby the bottom surface of the runners of the platform slide contiguously on a top surface of the upper pair of guide rails and beside the lower section pair of guide rails;

(c) a cable system comprised of a cable with two ends, a means to connect one end of the cable to the to the platform, a means for connecting the opposite end of the cable to a winch, a cable wear strip/angle, and runner wear pads/strip or angle; wherein the cable system is further comprised of a pulley system with a plurality of pulleys configured such that the cable encircles around the pulleys and guides the cable to the location of the winch; wherein at least one of the plurality of pulleys resting on the attic floor; and (d) the winch wherein the base assembly of the transport system is suspended by a cable of the cable system and the cable is lengthened and shortened by an operation of the winch and wherein the platform of the base assembly moves up and down an extended configuration of the folding attic stairway which permits the platform while carrying a load and during the operation of the winch, to reach and to rest on the attic floor and then to return back downward on the extended configuration of the folding attic stairway to reach the lower floor.

10. The system according to claim 9 wherein the motion of moving the platform assembly is by means of a powered winch.

11. The powered winch according to claim 10 is operated by an electric motor.

12. The Transport System for a folding attic stairway according to claim 9 wherein the means for connecting the upper and lower section guide rails to the platform is selected from the group consisting of adhesives, threaded bolts/nuts, threaded screws, nails, pins and heavy tacks for wood, welding, brazing, forming for metals, and molding process for composites and plastics.

13. The Transport System for a folding attic stairway in claim 9 wherein the durable materials of the platform of the base assembly is selected from the group consisting of wood, wood substitute, pressed wood, metals, aluminum, steel, steel alloys, durable plastics, and composite materials.

14. The Transport System for a folding attic stairway according to claim 9 wherein the means for connecting the cable is selected from the group consisting of eyelets and bolts; a single shank ball and washer; and clamps and thimbles.

15. The Transport System for a folding attic stairway according to claim 9 wherein the cable is selected from the group consisting of stranded metals, high tensile strength stranded metals, composite materials, high strength plastics, or strong rope.

16. The Transport System for a folding attic stairway according to claim 9 wherein the winch is selected from the group consisting of a manual crank, a mechanically assisted ratchet, an electrical motor, a hydraulic powered system; and a pneumatic powered system.

17. The Transport System for a folding attic stairway according to claim 16 wherein the powered winch is activated by a means selected from the group consisting of simple switch, a key, a key fob, a tethered switch; and a remote control device.

* * * * *